US010932044B2

(12) United States Patent
Hu et al.

(10) Patent No.: US 10,932,044 B2
(45) Date of Patent: Feb. 23, 2021

(54) SPEAKER

(71) Applicant: AAC Technologies Pte. Ltd., Singapore (SG)

(72) Inventors: Hongjian Hu, Shenzhen (CN); Shuai Li, Shenzhen (CN); Min Su, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,192

(22) Filed: Jul. 29, 2019

(65) Prior Publication Data

US 2020/0045432 A1 Feb. 6, 2020

(30) Foreign Application Priority Data

Aug. 1, 2018 (CN) ..... 201821236984.3

(51) Int. Cl.
*H04R 7/20* (2006.01)
*H04R 9/06* (2006.01)
*H04R 9/02* (2006.01)

(52) U.S. Cl.
CPC ..... *H04R 7/20* (2013.01); *H04R 9/02* (2013.01); *H04R 9/06* (2013.01); *H04R 2307/207* (2013.01); *H04R 2400/11* (2013.01); *H04R 2499/11* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,397,718 | B2 * | 8/2019 | Zhao | H04R 31/003 |
| 2006/0134982 | A1 * | 6/2006 | Zarganis | H05K 9/003 439/607.01 |
| 2013/0156237 | A1 * | 6/2013 | Kim | H04R 31/00 381/191 |
| 2014/0056465 | A1 * | 2/2014 | Li | H04R 9/025 381/400 |
| 2014/0153771 | A1 * | 6/2014 | Ohashi | H04R 9/06 381/412 |
| 2014/0169593 | A1 * | 6/2014 | Kwon | H04R 9/043 381/185 |

(Continued)

FOREIGN PATENT DOCUMENTS

| | | | | |
|---|---|---|---|---|
| CN | 205961439 | * | 2/2017 | H04R 9/06 |
| CN | 205961439 U | * | 2/2017 | H04R 9/06 |
| WO | WO-2012093058 A1 | * | 7/2012 | H04R 7/04 |

*Primary Examiner* — Oyesola C Ojo
(74) *Attorney, Agent, or Firm* — W&G Law Group LLP

(57) ABSTRACT

A speaker includes a holder and a vibration unit and a magnetic circuit unit fixed and held at the holder. The vibration unit includes: a first diaphragm and an elastic support located at an end of the voice coil facing away from the first diaphragm and elastically supporting the voice coil. The elastic support includes a flexible circuit board and a second diaphragm fixed and held at one side of the flexible circuit board facing away from the voice coil. The flexible circuit board is sandwiched between the voice coil and the second diaphragm and includes an upper surface fixed to the voice coil and a lower surface opposite to the upper surface. The second diaphragm is fixed to the lower surface by a binder, and the lower surface is recessed towards the upper surface to form a binder accommodation groove.

19 Claims, 6 Drawing Sheets

(56) References Cited

U.S. PATENT DOCUMENTS

| | | | | |
|---|---|---|---|---|
| 2015/0163597 | A1* | 6/2015 | Meng | H04R 9/025<br>381/412 |
| 2015/0189442 | A1* | 7/2015 | Zhang | H04R 9/025<br>381/409 |

* cited by examiner

SPEAKER

TECHNICAL FIELD

The present disclosure relates to the field of acoustic-electrical conversion, and in particular, to a speaker for a portable electronic product.

BACKGROUND

With the rapid development of technologies, audio devices become more and more popular, and among numerous recreation modes, high-quality music enjoyment is gradually popularized. Thus, speakers for playing audio have been greatly applied to existing smart mobile devices.

The speaker in the related art includes a holder and a vibration unit and a magnetic circuit unit that are fixed and held at the holder. The vibration unit includes a first diaphragm and a second diaphragm respectively arranged at two ends of the holder. The second diaphragm is fixedly connected with the holder by a flexible circuit board.

However, in the speaker in the related art, fixed connection is implemented by directly applying a binder between the flexible circuit board and the second diaphragm, so that the binder is easy to overflow to influence performance of other elements in the holder.

Therefore, it is necessary to provide a novel speaker so as to solve the above defect.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
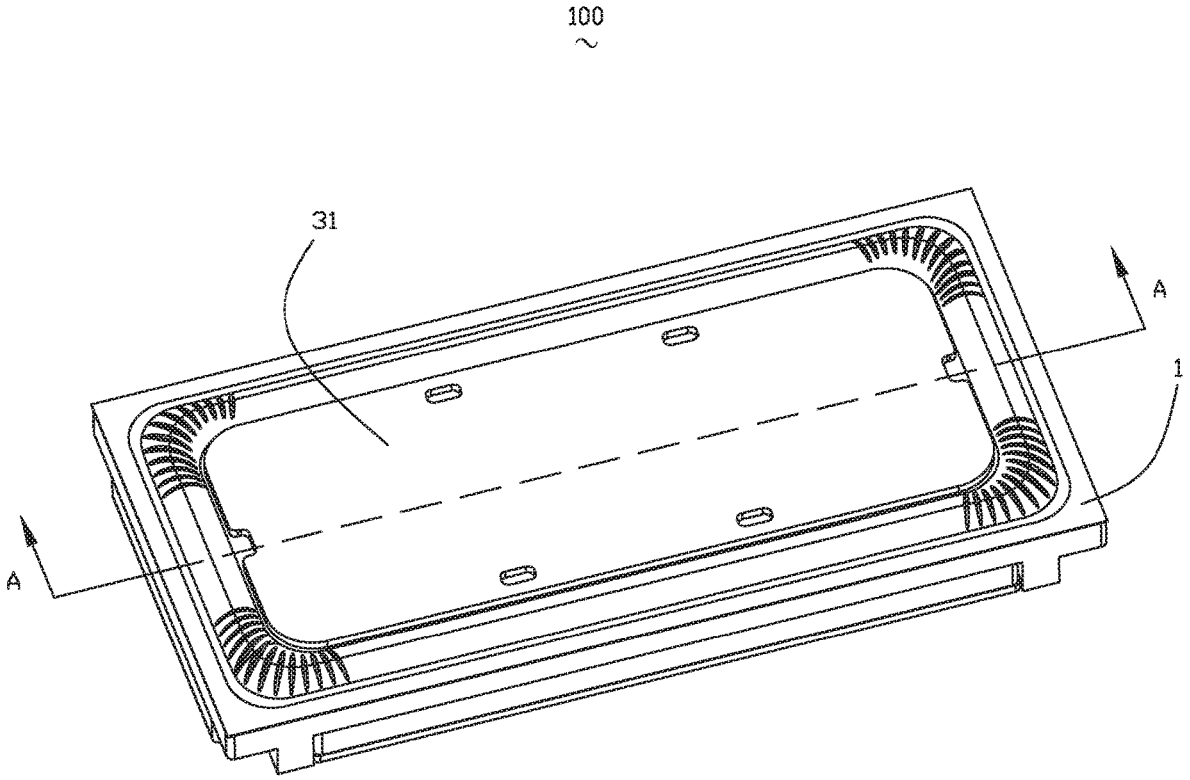
FIG. 1 is a perspective structural schematic diagram of a speaker according to the present disclosure.
Figure 2:
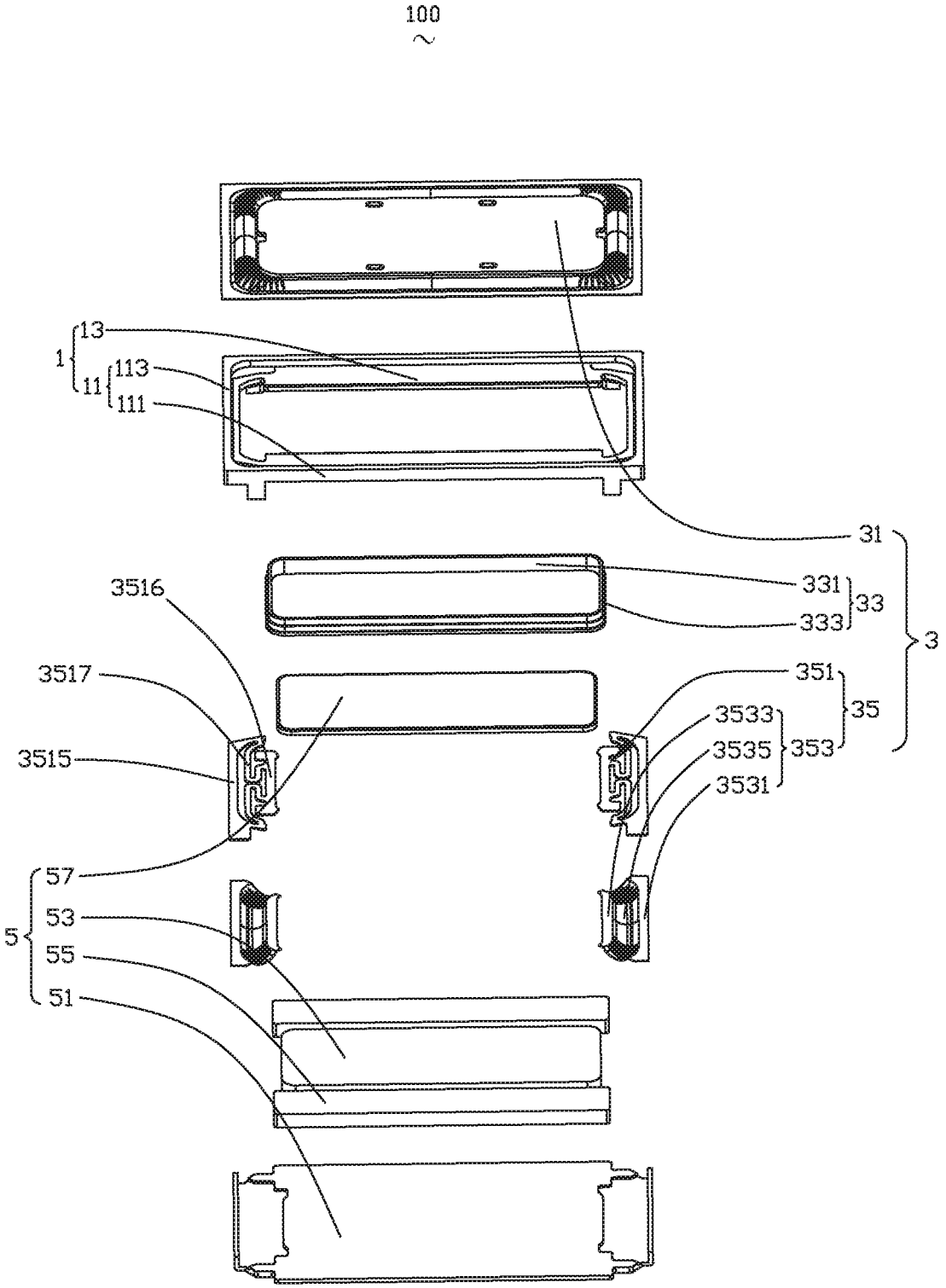
FIG. 2 is a perspective exploded structural schematic diagram of the speaker as shown in FIG. 1.
Figure 3:
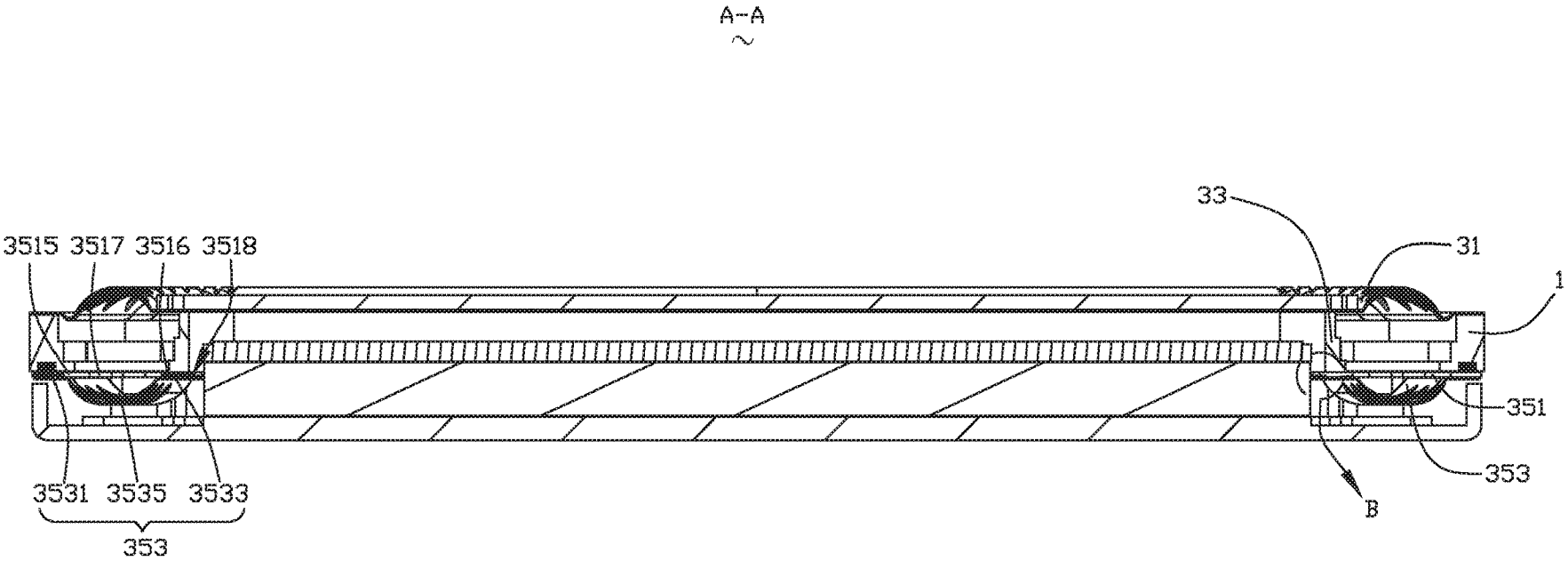
FIG. 3 is a cross-sectional diagram of the speaker taken along line A-A as shown in FIG. 1.

With reference FIG. 1 to FIG. 3, a speaker 100 includes a holder 1 and a vibration unit 3 and a magnetic circuit unit 5 that are fixed and held at the holder 1.

The holder 1 includes holder side walls 11 forming a receiving space in a surrounding mode and extension walls 13 extending inwards from two opposite holder side walls 11.

The holder side walls 11 includes two first holder side walls 111 provided with the extension walls 13 and two second holder side walls 113 respectively arranged at two ends of the two first holder side walls 111, and the first holder side walls 111 and the second holder side walls 113 are fixedly connected to enclose the receiving space. The holder 1 further comprising extension pillars 110 extending from a side of the first side 111 wall away from the first diaphragm 31, each one of the two elastic supports 35 are located between the extension pillars 110, the two elastic supports 35 having an orthographic projection on the holder 1 without overlapping with the extension pillars 110.

The vibration unit 3 includes: a first diaphragm 31; a voice coil 33 located on one side of the first diaphragm 31 and configured to drive the first diaphragm 31 to vibrate and emit sound; and an elastic support 35 located at one end of the voice coil 33 facing away from the first diaphragm 31, and configured to elastically support the voice coil 33.

The first diaphragm 31 is arranged on a sound emitting side of the speaker 100. For example, the first diaphragm 31 covers and is connected to the holder 1.

The voice coil 33 is received in the receiving space of the holder 1. The voice coil 33 includes two first side walls 331 arranged oppositely and two second side walls 333 arranged at two ends of the two first side walls 331 and respectively connected with the two first side walls 331. The two first side walls 331 and the two second side walls 333 are sequentially connected, head to tail, to form a rectangular ring-shaped structure. Particularly, a length of the first side wall 331 is greater than that of the second side wall 333.

The elastic support 35 and the first diaphragm 31 are respectively arranged on two sides of the voice coil 33. The elastic support 35 includes a flexible circuit board 351 and a second diaphragm 353 fixed and held at a side of the flexible circuit board 351 facing away from the voice coil 33. For example, there are two elastic supports 35, and the two elastic supports 35 are respectively arranged on two opposite sides of the voice coil. In this embodiment, the two elastic supports 35 and the two second side walls 333 are correspondingly arranged.

The flexible circuit board 351 is sandwiched between the voice coil 33 and the second diaphragm 353.

Figure 4:
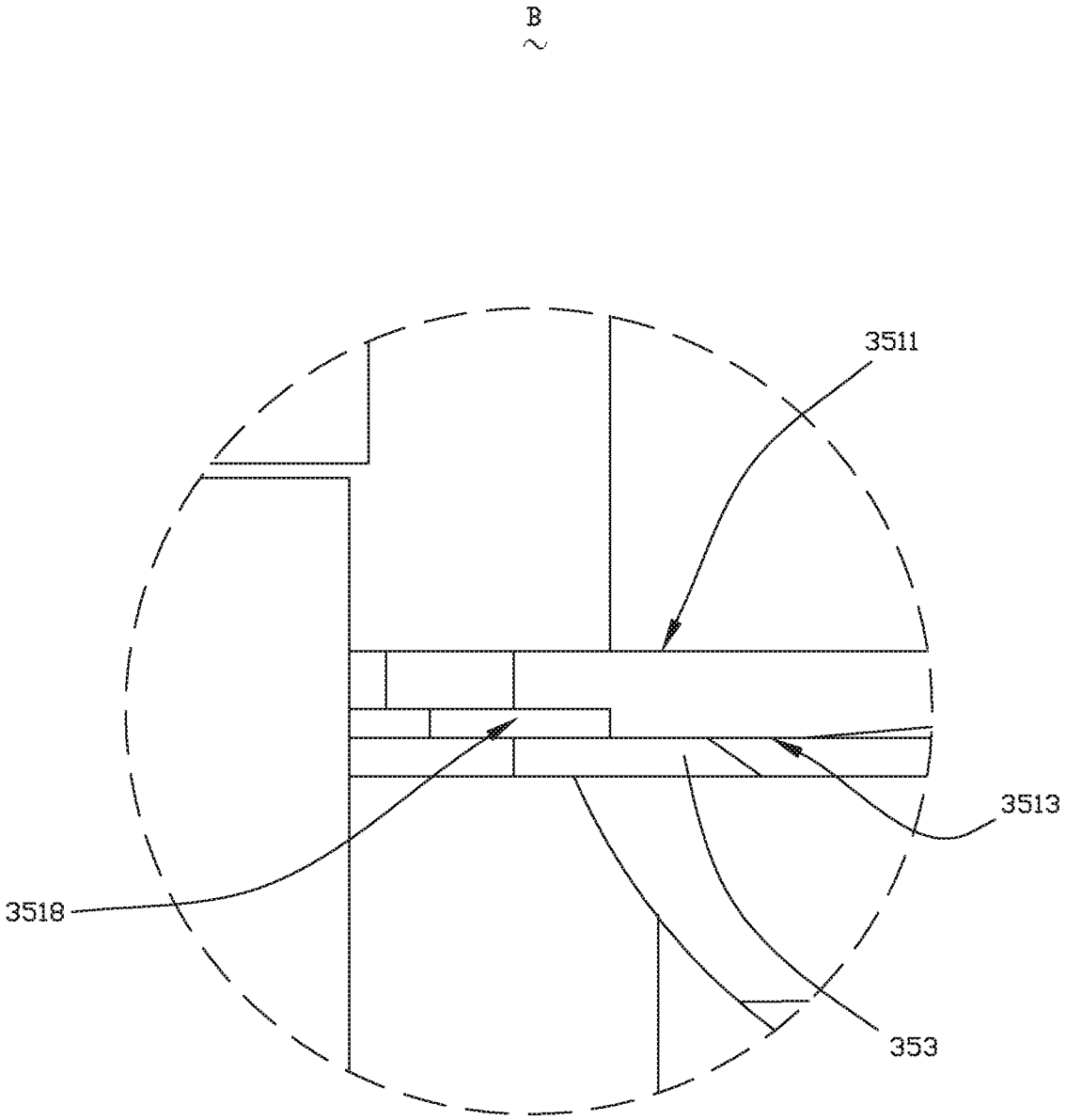
FIG. 4 is an enlarged view of Part B of the speaker as shown in FIG. 3.
Figure 5:
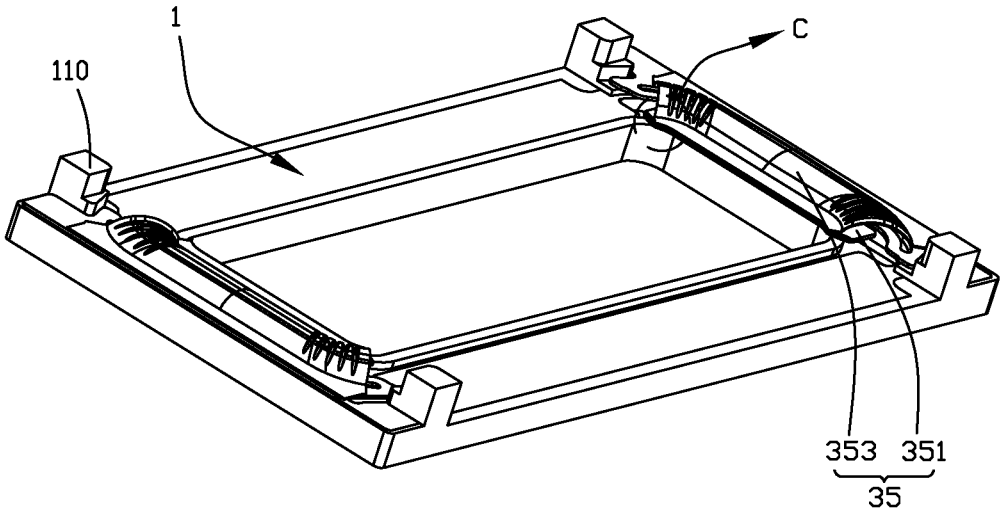
FIG. 5 is a stereoscopic structural schematic diagram of a part of a speaker according to the present disclosure.
Figure 6:
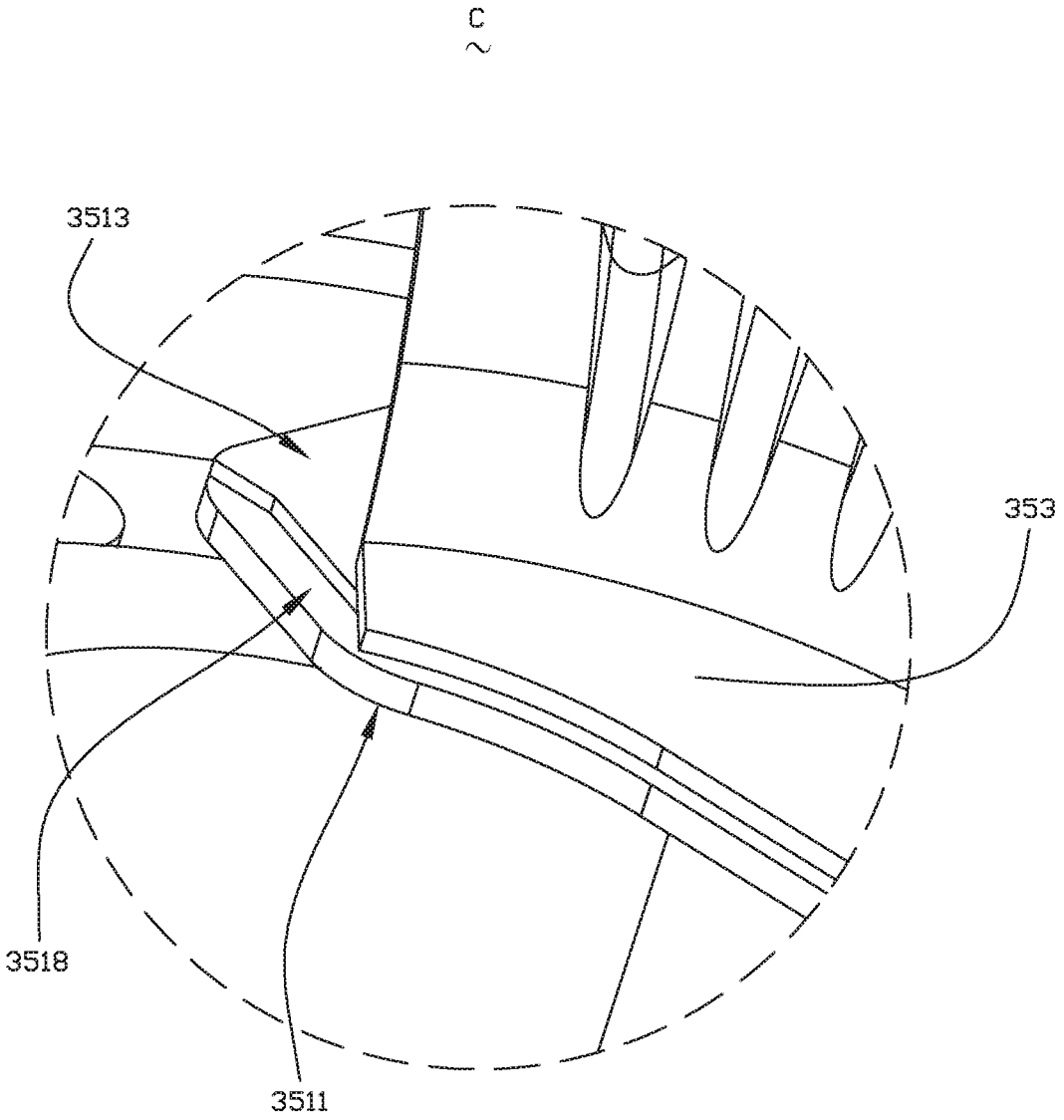
FIG. 6 is an enlarged view of Part C of the speaker as shown in FIG. 5.

With reference to FIG. 4 to FIG. 6, the flexible circuit board 351 includes an upper surface 3511 fixed to the voice coil 33, a lower surface 3513 opposite to the upper surface 3511, a first connection portion 3515 fixedly connected to the holder 1, a second connection portion 3516 fixedly connected to the voice coil 33, an elastic connection portion 3517 connected the first connection portion 3515 with the second connection portion 3516, and a binder accommodation groove 3518 formed by the lower surface 3513 being recessed towards the upper surface 3511. Fixed connection between the flexible circuit board 351 and the second diaphragm 353 may be achieved by gluing in the binder accommodation groove 3518. The binder accommodation groove 3518 is provided at the first connection portion 3515 and/or the second connection portion 3516.

In this embodiment, the binder accommodation groove 3581 is provided at one end of the second connection portion 3516 facing away from the first connection portion 3515, and the binder accommodation groove 3581 is communicated with a magnetic gap.

The second diaphragm 353 is fixed to the lower surface 3513 by a binder and is used for reinforcing vibration of the first diaphragm 31. The second diaphragm 353 includes a first fixed portion 3531 fixedly connected to the first connection portion 3515, a second fixed portion 3533 fixedly connected to the second connection portion 3516 and a suspension portion 3535 connected the first fixed portion 3531 with the second fixed portion 3533. The suspension portion 3535 is of an arc structure and protrudes towards a direction facing away from the flexible circuit board 351.

The present disclosure does not limit shapes of the first fixed portion 3531 and the second fixed portion 3533, but in order to reinforce a fixing effect between the second diaphragm 353 and the flexible circuit board 351, in this embodiment, the first fixed portion 3531 and the first connection portion 3515 are matched in shape, and the second fixed portion 3533 and the second connection portion 3516 are matched in shape.

By arranging the elastic support 35 for elastically supporting the voice coil 33, in one aspect, it takes an effect of reinforcing vibration of the first diaphragm 31, and in the other aspect, polarization of the voice coil 33 can be prevented.

The magnetic circuit unit 5 includes a yoke 51, a main magnet 53 assembled in the center of the yoke 51, an auxiliary magnet 55 assembled on the yoke 51 and surrounding the main magnet 53, and a main pole plate 57 attached to the main magnet 53. The main magnet 53 cooperates with the yoke 51 and the holder 1 to form the magnetic gap.

For example, the number of the auxiliary magnets 55 is two, and the auxiliary magnets 55 are symmetrically installed in a direction of the first holder side wall 111.

Compared to the related art, according to the speaker 100 provided by the present disclosure, by disposing the binder accommodation groove 3518 between the flexible circuit board 351 and the second diaphragm 353, in the gluing process, the binder can be stored in the binder accommodation groove 3518 so as to prevent overflow of the binder, ensure performance of the second diaphragm 353, meanwhile, enlarge a gluing area between the flexible circuit board 351 and the second diaphragm 353 and reinforce stability of connection between the flexible circuit board 351 and the second diaphragm 353.

The above merely are the embodiments of the present disclosure, and it should be noted that those skilled in the art also can make improvements, without departing from the creative conception of the present disclosure, which all shall fall within the scope of the present disclosure.

What is claimed is:

1. A speaker, comprising:

a holder;

a vibration unit fixed and held at the holder; and a magnetic circuit unit fixed and held at the holder, wherein the vibration unit comprises:

a first diaphragm;

a voice coil located on a side of the first diaphragm and configured to drive the first diaphragm to vibrate and emit sound; and at least one elastic support, each of the at least one elastic support being located at an end of the voice coil facing away from the first diaphragm and configured to elastically support the voice coil, wherein each of the at least one elastic support comprises a flexible circuit board and a second diaphragm fixed and held at one side of the flexible circuit board facing away from the voice coil, wherein the flexible circuit board is sandwiched between the voice coil and the second diaphragm and comprises an upper surface fixed to the voice coil and a lower surface opposite to the upper surface, and wherein the second diaphragm is fixed to the lower surface by a binder, and the lower surface is recessed towards the upper surface to form a binder accommodation groove.

2. The speaker as described in claim 1, wherein the flexible circuit board further comprises:

a first connection portion fixedly connected to the holder;

a second connection portion fixedly connected to the voice coil; and an elastic connection portion connecting the first connection portion with the second connection portion, wherein the binder accommodation groove is provided at the second connection portion and/or the first connection portion.

3. The speaker as described in claim 2, wherein the binder accommodation groove is provided at an end of the second connection portion facing away from the first connection portion, and the binder accommodation groove is communicated with a magnetic gap.

4. The speaker as described in claim 2, wherein the second diaphragm comprises:

a first fixed portion fixedly connected to the first connection portion;

a second fixed portion fixedly connected to the second connection portion; and a suspension portion connecting the first fixed portion with the second fixed portion, the suspension portion being of an arc structure and protruding in a direction facing away from the flexible circuit board.

5. The speaker as described in claim 4, wherein the first fixed portion and the first connection portion are matched in shape, and the second fixed portion and the second connection portion are matched in shape.

6. The speaker as described in claim 1, wherein the at least one elastic support comprises two elastic supports, and the two elastic supports are respectively arranged on two opposite sides of the voice coil.

7. The speaker as described in claim 2, wherein the at least one elastic support comprises two elastic supports, and the two elastic supports are respectively arranged on two opposite sides of the voice coil.

8. The speaker as described in claim 3, wherein the at least one elastic support comprises two elastic supports, and the two elastic supports are respectively arranged on two opposite sides of the voice coil.

9. The speaker as described in claim 4, wherein the at least one elastic support comprises two elastic supports, and the two elastic supports are respectively arranged on two opposite sides of the voice coil.

10. The speaker as described in claim 5, wherein the at least one elastic support comprises two elastic supports, and the two elastic supports are respectively arranged on two opposite sides of the voice coil.

11. The speaker as described in claim 6, wherein the voice coil comprises two first side walls arranged opposite to each other and two second side walls arranged at two ends of the two first side walls and respectively connected to the two first side walls, each of the two first side walls has a length greater than that of each of the two second side walls, and the two elastic supports and the two second side walls are correspondingly arranged.

12. The speaker as described in claim 7, wherein the voice coil comprises two first side walls arranged opposite to each other and two second side walls arranged at two ends of the two first side walls and respectively connected to the two first side walls, each of the two first side walls has a length greater than that of each of the two second side walls, and the two elastic supports and the two second side walls are correspondingly arranged.

13. The speaker as described in claim 8, wherein the voice coil comprises two first side walls arranged opposite to each other and two second side walls arranged at two ends of the two first side walls and respectively connected to the two first side walls, each of the two first side walls has a length greater than that of each of the two second side walls, and the two elastic supports and the two second side walls are correspondingly arranged.

14. The speaker as described in claim 9, wherein the voice coil comprises two first side walls arranged opposite to each other and two second side walls arranged at two ends of the two first side walls and respectively connected to the two first side walls, each of the two first side walls has a length greater than that of each of the two second side walls, and the two elastic supports and the two second side walls are correspondingly arranged.

15. The speaker as described in claim 10, wherein the voice coil comprises two first side walls arranged opposite to each other and two second side walls arranged at two ends of the two first side walls and respectively connected to the two first side walls, each of the two first side walls has a length greater than that of each of the two second side walls, and the two elastic supports and the two second side walls are correspondingly arranged.

16. The speaker as described in claim 6, wherein the holder includes holder side walls forming a receiving space surrounding the magnetic circuit unit and extension walls extending inwards from two opposite holder side walls.

17. The speaker as described in claim 16, wherein the holder side walls includes two first holder side walls provided with the extension walls and two second holder side walls respectively arranged at two ends of the two first holder side walls, and the first holder side walls and the second holder side walls are fixedly connected to enclose the receiving space.

18. The speaker as described in claim 17, wherein, the two elastic supports are separated with each other and the two elastic supports are respectively fixed to the second side walls.

19. The speaker as described in claim 18, wherein, the holder further comprising extension pillars extending from a side of the second side wall away from the first diaphragm, each one of the two elastic supports are located between the extension pillars, the two elastic supports having an orthographic projection on the holder without overlapping with the extension pillars.

* * * * *